US011098543B2

(12) United States Patent
Hrupp et al.

(10) Patent No.: US 11,098,543 B2
(45) Date of Patent: Aug. 24, 2021

(54) HYDRAULIC PRESSURE CONVERTER WITH MODULAR FORCE MULTIPLIER FOR DOWNHOLE TOOLS

(71) Applicant: Exacta-Frac Energy Services, Inc., Conroe, TX (US)

(72) Inventors: Joze John Hrupp, Montgomery, TX (US); Ahmed Mohamed Saeed, Cypress, TX (US)

(73) Assignee: EXACTA-FRAC ENERGY SERVICES, INC., Conroe, TX (US)

( * ) Notice: Subject to any disclaimer, the term of this patent is extended or adjusted under 35 U.S.C. 154(b) by 147 days.

(21) Appl. No.: 16/537,834

(22) Filed: Aug. 12, 2019

(65) Prior Publication Data

US 2021/0047893 A1 Feb. 18, 2021

(51) Int. Cl.

| | |
|---|---|
| ***E21B 23/04*** | (2006.01) |
| ***E21B 43/112*** | (2006.01) |
| ***E21B 23/06*** | (2006.01) |

(52) U.S. Cl.

CPC ..... *E21B 23/04* (2013.01); *E21B 23/06* (2013.01); *E21B 43/112* (2013.01)

(58) Field of Classification Search

CPC ..... E21B 23/04; E21B 23/06; E21B 43/112; E21B 43/114; E21B 23/00

See application file for complete search history.

(56) References Cited

U.S. PATENT DOCUMENTS

| | | | | |
|---|---|---|---|---|
| 2,624,412 | A | 1/1953 | Ragan | |
| 2,769,497 | A | 11/1956 | Reistle, Jr. | |
| 2,927,638 | A | 3/1960 | Hall, Sr. | |
| 3,090,436 | A | 5/1963 | Briggs, Jr. | |
| 4,519,456 | A * | 5/1985 | Cochran | E21B 37/08 166/147 |
| 5,152,340 | A * | 10/1992 | Clark | E21B 33/124 166/106 |
| 5,383,520 | A | 1/1995 | Tucker et al. | |
| 5,803,177 | A | 9/1998 | Hriscu et al. | |
| 5,810,082 | A | 9/1998 | Jordan, Jr. | |
| 5,890,540 | A | 4/1999 | Pia et al. | |
| 5,904,207 | A | 5/1999 | Rubbo et al. | |
| 6,253,856 | B1 | 7/2001 | Ingram et al. | |
| 6,484,805 | B1 | 11/2002 | Perkins et al. | |
| 6,564,876 | B2 | 5/2003 | Vaynshteyn et al. | |
| 6,776,239 | B2 | 8/2004 | Elsinger et al. | |
| 6,832,654 | B2 | 12/2004 | Ravensburger et al. | |
| 6,883,610 | B2 * | 4/2005 | Depiak | E21B 33/124 166/177.5 |
| 7,377,834 | B2 | 3/2008 | Surjaatmadja et al. | |
| 7,500,526 | B2 | 3/2009 | Telfer | |

(Continued)

FOREIGN PATENT DOCUMENTS

DE 3407342 A1 8/1985

OTHER PUBLICATIONS

Requisition by Canadian Patent Examiner dated Mar. 16, 2021—5 pages.

*Primary Examiner* — Yong-Suk (Philip) Ro

(74) *Attorney, Agent, or Firm* — J. Bennett Mullinax, LLC

(57) ABSTRACT

A hydraulic pressure converter with a force multiplier converts fluid pressure pumped down a work string from the surface into a multiplied linear force. The multiplied linear force can be used to operate downhole tools to perform tasks requiring the application of linear force.

19 Claims, 8 Drawing Sheets

(56) References Cited

U.S. PATENT DOCUMENTS

| | | | | |
|---|---|---|---|---|
| 7,789,163 | B2 | 9/2010 | Kratochvil et al. | |
| 8,201,631 | B2 | 6/2012 | Stromquist et al. | |
| 8,336,615 | B2 | 12/2012 | Hughes et al. | |
| 8,490,702 | B2 | 7/2013 | Stromquist et al. | |
| 8,950,505 | B2 * | 2/2015 | Themig | E21B 23/06 166/387 |
| 9,016,390 | B2 | 4/2015 | Stewart et al. | |
| 9,334,714 | B2 | 5/2016 | Stromquist et al. | |
| 9,580,990 | B2 * | 2/2017 | Flores | E21B 23/006 |
| 9,598,939 | B2 | 3/2017 | Lee | |
| 2005/0077053 | A1 | 4/2005 | Walker et al. | |
| 2007/0034370 | A1 | 2/2007 | Moyes | |
| 2007/0235194 | A1 * | 10/2007 | Maier | E21B 33/124 166/305.1 |
| 2008/0011471 | A1 | 1/2008 | Hughes et al. | |
| 2008/0053652 | A1 * | 3/2008 | Corre | E21B 33/1243 166/179 |
| 2015/0376979 | A1 | 12/2015 | Mitchell et al. | |
| 2016/0369585 | A1 | 12/2016 | Limb et al. | |
| 2018/0051542 | A1 | 2/2018 | Radtke | |

* cited by examiner

HYDRAULIC PRESSURE CONVERTER WITH MODULAR FORCE MULTIPLIER FOR DOWNHOLE TOOLS

CROSS REFERENCE TO RELATED APPLICATIONS

This is the first application for this invention.

FIELD OF THE INVENTION

This invention relates in general to tools for performing downhole operations that require an application of mechanical force and, in particular, to a novel hydraulic pressure converter with modular force multiplier for generating linear mechanical force for downhole tool operations on an as-required basis.

BACKGROUND OF THE INVENTION

Numerous arrangements for providing linear mechanical force to perform operations with downhole tools for accomplishing certain tasks are known and have been widely used. For example, piston assemblies for converting pumped fluid pressure to mechanical force in a downhole tool are used in downhole tools such as packers, straddle packers, tubing perforators, and the like. Such piston assemblies employ a plurality of pistons connected in series to an inner or outer mandrel of a downhole tool to increase the piston area, and thereby increase the linear force that can be generated using fluid pumped down a work string to the downhole tool. An example of one such piston assembly can be found in U.S. Pat. No. 4,487,258 which issued on Dec. 11, 1984 to Jackson. While such piston assemblies have proven useful, another mechanism of converting pumped fluid pressure to linear force is desirable.

There therefore exists a need for a hydraulic pressure converter with modular force multiplier for generating linear mechanical force for downhole tool operations.

SUMMARY OF THE INVENTION

It is therefore an object of the invention to provide a hydraulic pressure converter with modular force multiplier for generating linear mechanical force for downhole tool operations.

The invention therefore provides a hydraulic pressure converter with a force multiplier, comprising: a mandrel having a mandrel central passage and mandrel piston ports that provide fluid communication through a sidewall of the mandrel; a converter piston that reciprocates on the mandrel and has converter piston ports in fluid communication with the mandrel piston ports; a small piston that reciprocates on the mandrel and is connected to a distal end of the converter piston, the small piston reciprocating within a small piston chamber filled with a contained fluid; a large piston that reciprocates on the mandrel within a large piston chamber in fluid communication with the small piston chamber; and an output force hub connected to the large piston and reciprocating therewith; whereby fluid pressure in the mandrel central passage urges the converter piston to move the small piston with a first force that is multiplied by the large piston and output by the output force hub.

The invention further provides a straddle packer comprising: a first hydraulic pressure converter with a force multiplier having a work string connector that supports a first packer element connected to an output force hub end thereof, and a first mandrel tube connected to a connector sleeve end thereof; a second hydraulic pressure converter with a force multiplier having a transition hub that supports a second packer element connected to the output force hub end thereof, and a second mandrel tube connected to a connector sleeve end thereof; and a fluid injection sub that interconnects free ends of the first and second mandrel tubes.

The invention yet further provides a hydraulic pressure converter with a force multiplier comprising: a connector sleeve having first and second ends, the first end having a connector sleeve connector end adapted to connect to one of a work string connector and a downhole tool component; a piston sleeve having first and second ends, the first end being connected to the second end of the connector sleeve; a force multiplier sleeve having first and second ends, the first end being connected to the second end of the piston sleeve and the second end supporting a force multiplier sleeve end cap; a converter piston having first and second ends that reciprocates on a mandrel within the piston sleeve in response to fluid pressure within the mandrel that is communicated through mandrel piston ports in the mandrel and converter piston ports in the converter piston to a converter piston chamber; a small piston connected to the second end of the converter piston and reciprocating therewith on the mandrel in a small piston chamber within the force multiplier sleeve, the small piston chamber being filled with a contained fluid; a large piston that reciprocates on the mandrel in a large piston chamber within the force multiplier sleeve, the large piston reciprocating in response to displacement of the contained fluid by the small piston; a force multiplier sleeve connected to the large piston and reciprocating on the mandrel with the large piston; and an output force hub connected to the force multiplier sleeve and reciprocating on the mandrel therewith.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
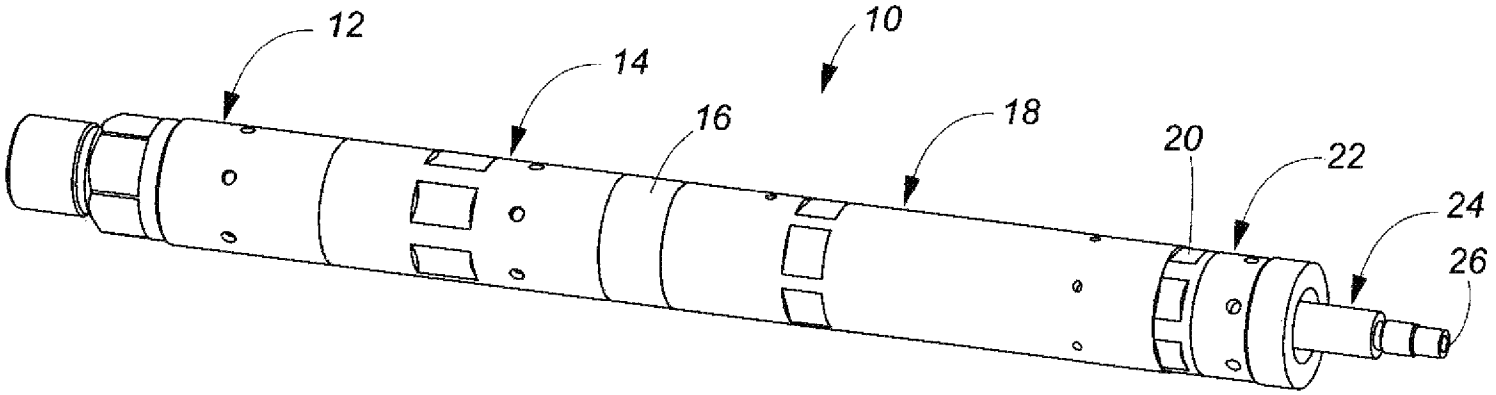
FIG. 1 is a perspective view of one embodiment of a hydraulic pressure converter with modular force multiplier in accordance with the invention, shown in an un-energized condition.

The invention provides a hydraulic pressure converter with modular force multiplier (hereinafter simply "pressure multiplier") for downhole tools that require linear force to perform a downhole task. The pressure multiplier converts fluid pressure pumped down a work string connected to the pressure multiplier into linear mechanical force that is used in a downhole tool to accomplish the required downhole task. The downhole tool can be used to, by way of example only: set slips; set packers; perforate a casing or tubing; open or close a sliding sleeve; or, perform many other downhole tool functions, or combination of downhole tool functions, that require the application of linear mechanical force. The pressure multiplier uses a hydraulic piston to convert fluid pressure pumped down the work string into a mechanical force that is multiplied by the force multiplier. Contained hydraulic fluid is used in the force multiplier to multiply linear force generated by the hydraulic piston. The force multiplier may be modular and the number of modules in the modular force multiplier determines an amount of force multiplication. Each additional module in the modular force multiplier increases a multiplication of the linear farce by about a factor of two.

The pressure multiplier permits the generation of linear mechanical force without the use of work string manipulations, which is advantageous in long lateral well bores because precise work string manipulation becomes unreliable in those well bores due to factors well understood in the art.

| Part No. | Part Description |
|---|---|
| 10, 10a | Pressure multiplier |
| 12 | Connector sleeve |
| 14 | Piston sleeve |
| 16 | Transition sleeve |
| 18, 18a | Force multiplier sleeve |
| 20 | Output force sleeve |
| 22 | Output force hub |
| 24 | Mandrel |
| 26 | Mandrel central passage |
| 28 | Force-boost area |
| 30 | Connector sleeve connector end |
| 32 | Connector sleeve pressure balance ports |
| 34 | Piston sleeve seal retainer nut |
| 36 | Piston sleeve seal |
| 38 | Piston sleeve pressure balance ports |
| 40 | Transition sleeve seal retainer nut |
| 42 | Transition sleeve seal |
| 43 | Seal retainer ring |
| 44 | Force mulpier sleeve seal |
| 46 | Force multiplier fill plug |
| 47 | Contained fluid |
| 48 | Force multiplier pressure balance ports |
| 49 | Output force hub pressure balance ports |
| 50 | Force multiplier sleeve end cap |
| 52 | Seal sleeve |
| 54 | Seal sleeve retainer nut |
| 56 | Seal sleeve seal |
| 58 | Converter piston |
| 60 | Converter piston ports |
| 62 | Converter piston chamber |
| 64 | Converter piston seal |
| 66 | Converter piston seal retainer nut |
| 68 | Converter piston seal retainer nut lock ring |
| 70 | Multiplier transition sleeve |
| 72 | Small piston seal ring |

-continued

| Part No. | Part Description |
|---|---|
| 74 | Small piston upper seal |
| 76 | Small piston lower seal |
| 78 | Small piston |
| 80 | Small piston chamber |
| 81 | Large piston chamber |
| 82 | Large piston |
| 84 | Large piston seal |
| 85 | Large piston seal retainer washer |
| 86 | Mandrel converter piston component |
| 88 | Mandrel connector thread |
| 90 | Mandrel piston ports |
| 92 | Mandrel small piston component |
| 94 | Mandrel large piston component |
| 96 | Mandrel transition component |
| 98 | Mandrel transition connector end |
| 100 | Long reach straddle packer |
| 101 | Work string connection component |
| 102 | Mandrel tubing |
| 103 | Uphole packer element |
| 104 | Fluid injection sub |
| 105 | Downhole packer element |
| 106 | Fluid injection nozzles |
| 107 | Transition hub |
| 108 | Velocity bypass sub |
| 110 | Tool end cap |
| 120 | Casing perforator |
| 122 | Casing perforator body |
| 124 | Casing perforator blades |
| 126 | Casing perforator blade ramps |
| 128 | Compression Spring |

FIG. 1 is a perspective view of one embodiment of a pressure multiplier 10 in accordance with the invention, shown in an un-energized condition used to run a downhole tool to a desired location within a cased or an open well bore. In one embodiment, the pressure multiplier 10 includes a connector sleeve 12 having a first end and a second end. The first end of the connector sleeve is used, for example, to connect the pressure multiplier 10 to a work string connection component 101 (see FIG. 7 or 8) to permit the pressure multiplier 10 to be coupled to a jointed or coil tubing work string (not shown) in a manner well understood in the art. A piston sleeve 14 having a first end and a second end is connected to the second end of the connector sleeve 12. A transition sleeve 16 interconnects the second end of the piston sleeve 14 to a first end of a force multiplier sleeve 18. An output force sleeve 20 abuts a second end of the force multiplier sleeve 18. An output, force hub 22 is connected to the output force sleeve 20. A mandrel 24, in this embodiment a modularized mandrel which will be explained with reference to FIGS. 3-6, extends through the pressure multiplier 10 from the connector sleeve 12 and through the output force hub 22. The mandrel 24 has an uninterrupted mandrel central passage 26 that provides a fluid path through the pressure multiplier 10, as will be explained below in more detail with reference to FIG. 3.

Figure 2:
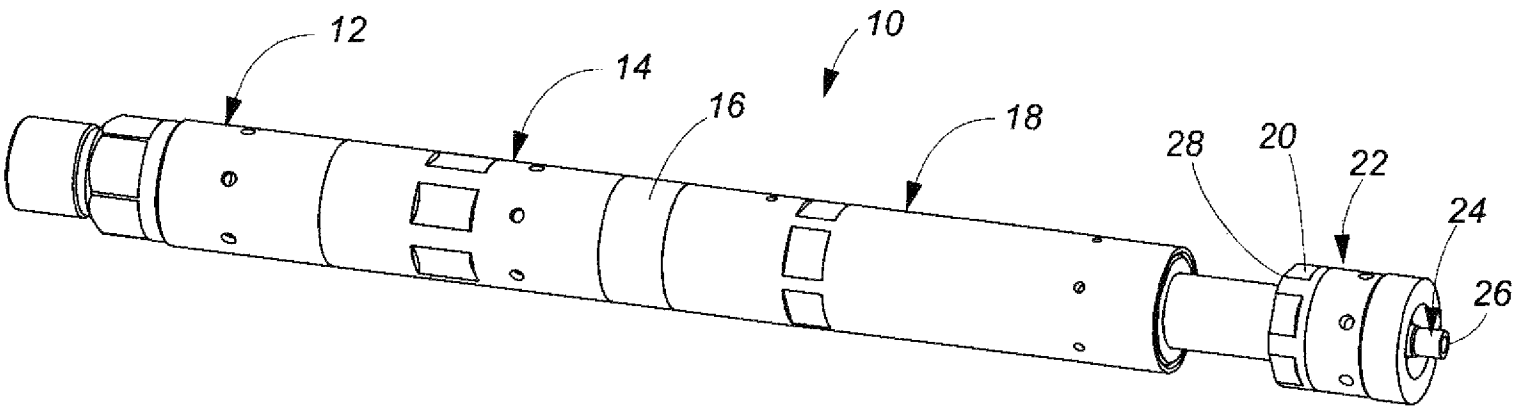
FIG. 2 is a perspective view of the embodiment of the hydraulic pressure converter with modular force multiplier seen in FIG. 1, shown in a fully energized condition.

FIG. 2 is a perspective view of the embodiment of the pressure multiplier 10 shown in FIG. 1, in a fully energized condition. In the fully energized condition, the output force sleeve 20 and connected output force hub 22 are extended over the mandrel 24, providing linear force that may be used to operate a downhole tool, as will be explained below in more detail with reference to FIGS. 7-10. If the downhole tool isolates pumped fluid pressure in a well bore annulus, for example a straddle packer which will be explained below with reference to FIG. 7, the linear force output by the pressure multiplier 10 is further boosted by a force-boost area 28 on the output force sleeve 20 to further increase the linear force output of the output force hub 22 as the isolated fluid pressure acts on the force-boost area 28 to augment the output force.

Figure 3:
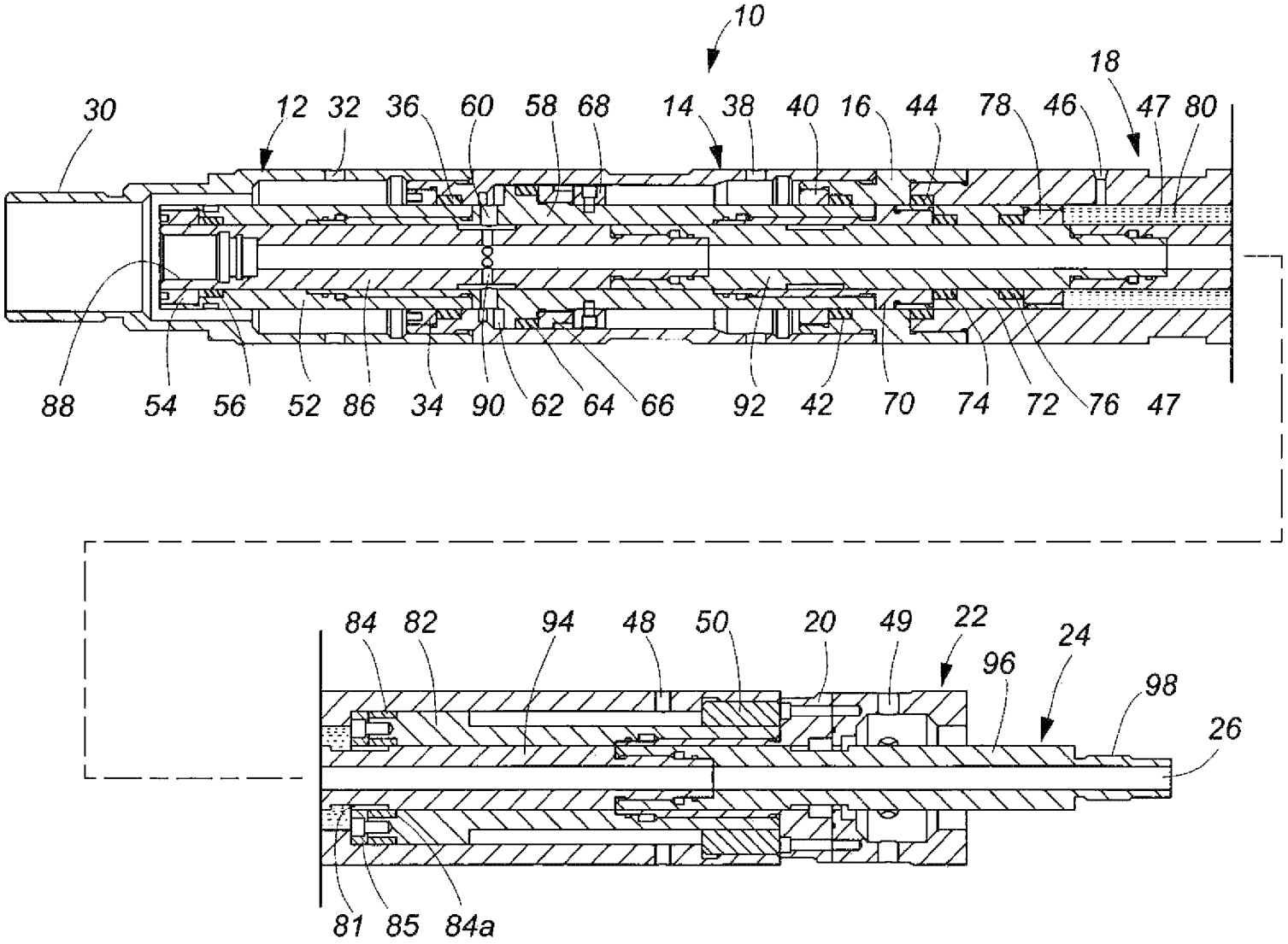
FIG. 3 is a cross-sectional view of the hydraulic pressure converter with modular force multiplier shown in FIG. 1.

FIG. 3 is a cross-sectional view of the pressure multiplier 10 shown in FIG. 1. The first end of the connector sleeve 12 is a connector sleeve connector end 30 that is used to connect the pressure multiplier 10 to a downhole tool component or a work string connector, as will be explained below in more detail with reference to FIGS. 7-9. The connector sleeve 12 also has a plurality of connector sleeve pressure balance ports 32 that permit pressure equalization within the connector sleeve 12 as the pressure multiplier 10 is shifted from the un-energized condition shown in FIG. 1 to the fully energized condition shown in FIG. 2, or vice versa. A piston seal retainer nut 34 retains an elastomeric piston sleeve seal 36 in, an end of the piston sleeve 14 connected to the connector sleeve 12. A plurality of piston sleeve pressure balance ports 38 balance fluid pressure on a back side of a converter piston 58 as it reciprocates on the mandrel 24 in response to variations in pumped fluid pressure within the mandrel central passage 26. A transition sleeve seal retainer nut 40 threadedly connected to the transition sleeve 16 retains a transition sleeve seal 42, which inhibits a migration of well bore fluid and/or debris from the back side of the converter piston 58. A force multiplier sleeve seal 44 retained in a seal groove in the first end of the force multiplier sleeve 18 inhibits an egress of contained fluid 47 from a small piston chamber 80. A force multiplier fill plug 46 permits a contained fluid 47 (a hydraulic fluid, for example) to be introduced into the small piston chamber 80. Force multiplier pressure balance ports 48 balance fluid pressure on a back side of a large piston 82 that reciprocates within a large piston chamber 81 in the force multiplier sleeve 18. A force multiplier sleeve end cap 50 connected to the second, distal end of the force multiplier sleeve 18 limits a travel of the large piston 82, and consequently a travel of the output force hub 22, which is connected to a distal end of the large piston 82 by the output force sleeve 20. Output force hub pressure balance ports 49 equalize fluid pressure within the output force hub 22 as it reciprocates on the mandrel 24 from the un-energized condition shown in FIG. 1 to the fully energized condition shown in FIG. 2.

A seal sleeve 52 having a first end and a second end is threadedly connected to the converter piston 58. A seal sleeve retainer nut 54 connected to the first end of the seal sleeve retains a seal sleeve seal 56 that provides a high-pressure fluid seal with the mandrel 24 to prevent an egress of high-pressure fluid pumped downhole through the mandrel central passage 26 into a piston chamber 62 which is in fluid communication with converter piston ports 60 and mandrel piston ports 90. A converter piston seal 64 prevents an egress of the high-pressure fluid from the piston chamber 62. The converter piston seal 64 is retained by a converter piston seal retainer nut 66, which is in turn secured by a converter piston seal retainer nut lock ring 68. A multiplier transition sleeve 70 interconnects a second, distal end of the converter piston 58 and a small piston seal ring 72. The small piston seal ring 72 retains a small piston upper seal 74, a small piston lower seal 76 and a small piston 78. The small piston upper seal 74 inhibits an egress of high-pressure fluid from the piston chamber 62 and the small piston lower seal 76 inhibits an egress of the contained fluid 47 from the small piston chamber 80. The large piston chamber 81 is in fluid communication with the small piston chamber 80. The large piston 82 is reciprocated within the large piston chamber 81 by reciprocation of the small piston 78 by the converter piston 58. The small piston 78 displaces the contained fluid 47 in the small piston chamber 80. As explained above, the contained fluid 47 (a commercially available hydraulic fluid, for example) is introduced into the small piston chamber 80 via the force multiplier fill plug 46. Large piston seals 84, **84*a* are retained by a large piston seal retainer washer 85. The large piston seals 84, 84*a* inhibit an egress of contained fluid 47 from the large piston chamber 81. As noted above, the output force sleeve 20 is threadedly connected to the distal end of the large piston 82**.

The mandrel 24 slidably supports components of the pressure multiplier 10, which reciprocate between the un-energized condition shown in FIG. 1 and the fully energized condition shown in FIG. 2. In this exemplary embodiment the mandrel 24 is a modular mandrel. A mandrel converter piston component 86 has a mandrel connector thread 88 that secures the mandrel 24, via the work string connection component 101 to a work string (not shown), or to another downhole tool component, as will be explained below in more detail. The mandrel converter piston component 86 is provided with the mandrel piston ports 90 referred to above, which provide fluid communication between the mandrel central passage 26 and the converter piston ports 60. A mandrel small piston component 92 is threadedly connected to the mandrel converter piston component 86. A mandrel large piston component 94 is threadedly connected to the mandrel small piston component 92. A mandrel transition component 96 having a mandrel transition connector end 98 is connected to the mandrel large piston component 94. The mandrel transition component 96 and the mandrel transition connector end 98 are used to connect downhole tool components to the pressure multiplier 10, as will be explained by way of example with reference to FIGS. 7-10. As will be understood by those skilled in the art, a shape and configuration of the mandrel transition component 96 and connector end 98 may be configured as required to accommodate the requirements of the downhole tool or downhole tool component. As will be further understood in the art, the mandrel small piston component 92, the mandrel large piston component 94 and the mandrel transition component 96 are identical and interchangeable and are only referred to by different names to facilitate description. As will be further understood by those skilled in the art, the mandrel 24 is constructed in separate components to facilitate modularization and assembly. The mandrel 24 may be constructed as a unitary body of a required length without any compromise in the functionality of the force multipliers described herein.

Figure 4:
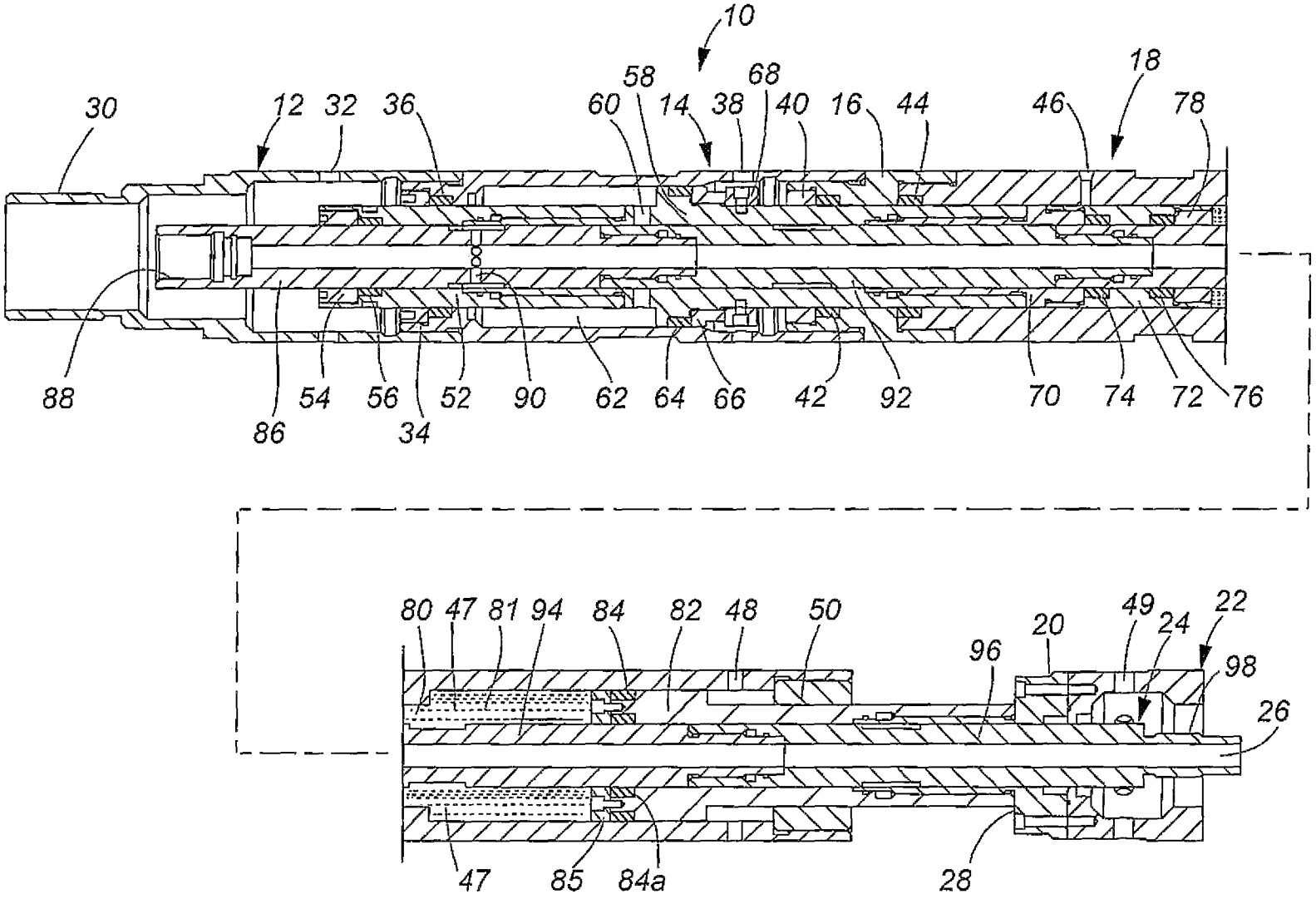
FIG. 4 is a cross-sectional view of the hydraulic pressure converter with modular force multiplier shown in FIG. 2.

FIG. 4 is a cross-sectional view of the pressure multiplier 10 in the fully energized condition shown in FIG. 2. As can be seen, in the fully energized condition, high-pressure fluid pumped into the central passage 26 of the mandrel 24 flows through the mandrel piston ports 90 that provide fluid communication through a sidewall of the mandrel 24, and the converter piston ports 60 that provide fluid communication through the converter piston 58 into the converter piston chamber 62, urging the converter piston 58 to the fully energized condition. That movement of the converter piston 58 displaces the small piston 78 to near an end of the small piston chamber 80, which in turn displaces the contained fluid 47 into the large piston chamber 81, thereby urging the large piston 82 and the output force hub 22 to the fully energized condition shown. In this embodiment, a difference in a respective surface area exposed to the contained fluid 47 of the small piston 78 with respect to the large piston 82 multiplies a linear force generated by the converter piston 58 by a factor of about 2.

Figure 5:
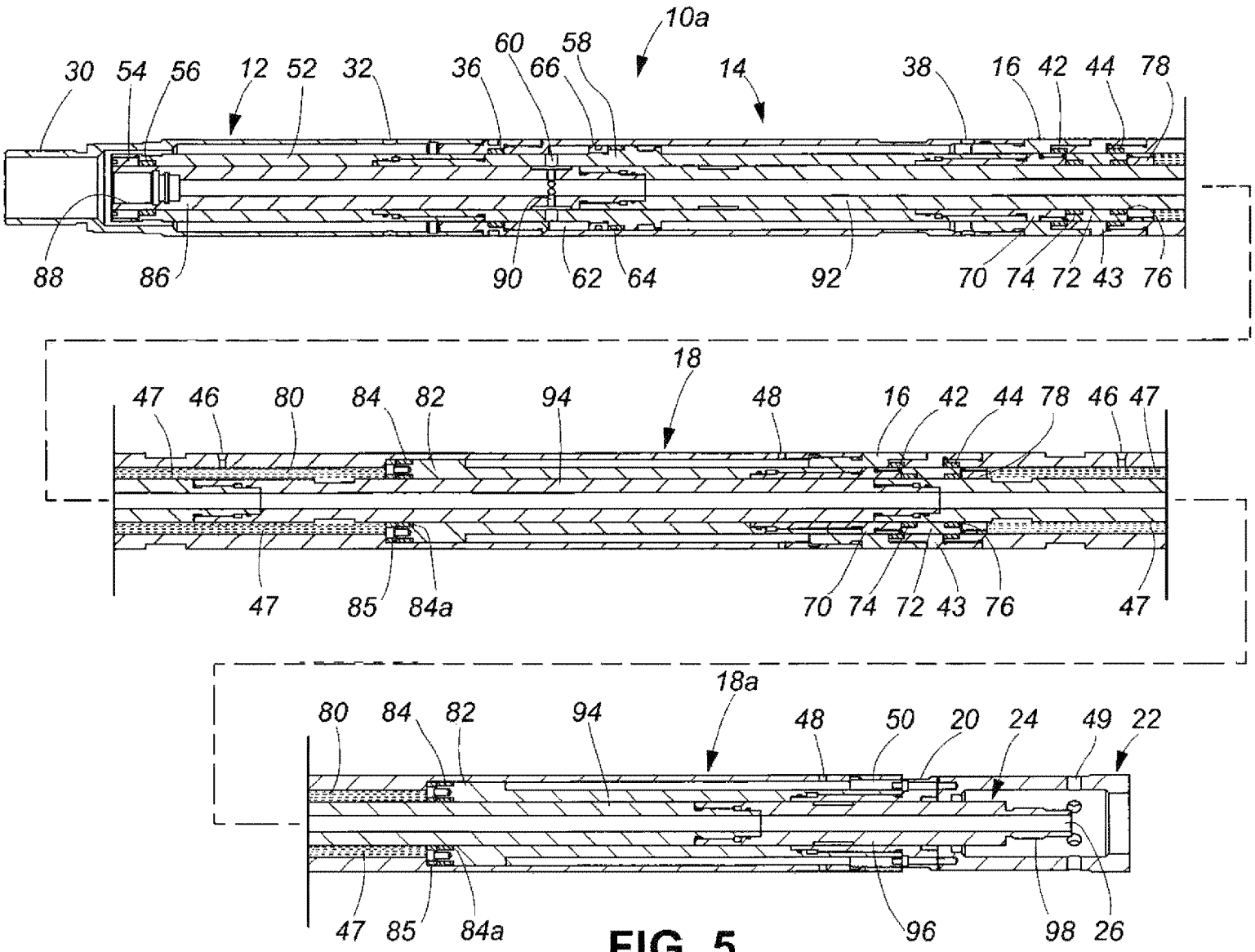
FIG. 5 is a cross-sectional view of another embodiment of a hydraulic pressure converter with modular force multiplier in accordance with the invention, shown in an un-energized condition.

FIG. 5 is a cross-sectional view of another embodiment of a hydraulic pressure converter with/nodular force multiplier

10*a* in accordance with the invention, shown in an un-energized condition. The pressure multiplier 10*a* is substantially as described above with reference to FIGS. 1-4, with an exception that the pressure multiplier 10*a* has two force multiplier modules, and the transition sleeve seals 42 and force multiplier sleeve seals 44 are retained by seal retainer rings 43. Furthermore, each force multiplier module has a force multiplier sleeve, respectively 18 and 18*a*, a small piston 78, a large piston 82 and a mandrel large piston component 94. The large pistons 82 also have two large piston seals 84, 84*a* and each large piston seal 84, 84*a* is retainer by a large piston seal retainer washer 85. There are also two force multiplier fill plugs 46 that seal ports for filling the respective small piston chambers 80 with contained fluid 47.

Figure 6:
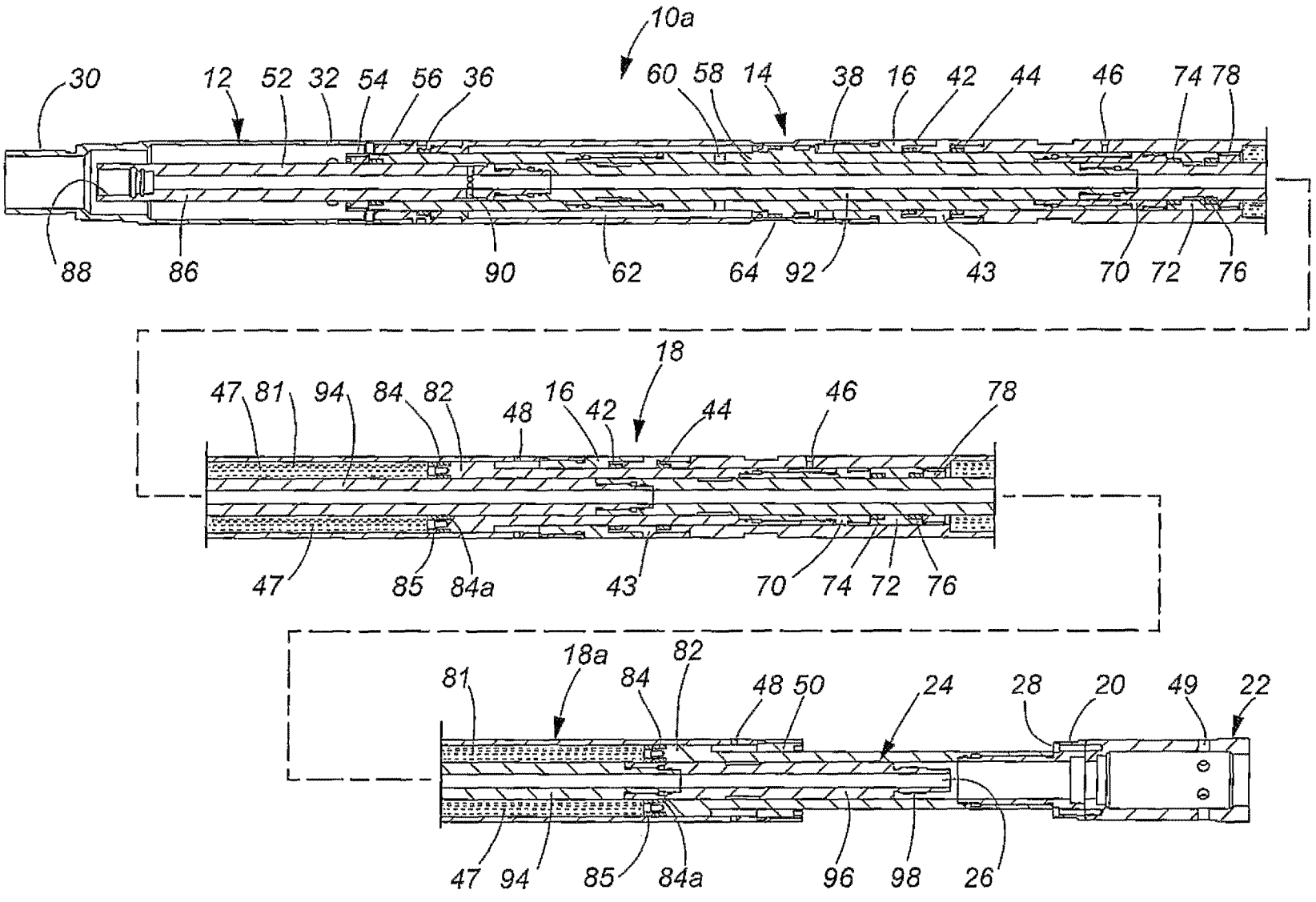
FIG. 6 is a cross-sectional view of the hydraulic pressure converter with modular force multiplier shown in FIG. 5, shown in a fully energized condition.

FIG. 6 is a cross-sectional view of the hydraulic pressure multiplier with modular force multiplier 10*a* shown in FIG. 5, seen in a fully energized condition. In this embodiment the second small piston 78 is connected to a lower end of the first large piston 82 and displaces the contained fluid 47 that moves the second large piston 82. This multiplies a force generated by the converter piston 58 by a factor of around 4, depending on a respective diameter of the small pistons 78 and large pistons 82. If more force is required for a downhole tool operation, additional force multiplier modules may be added to the pressure multiplier 10*a*. For example, a third force multiplier module will multiply a force applied to the converter piston 58 by a factor of about 8, etc.

Figure 7:
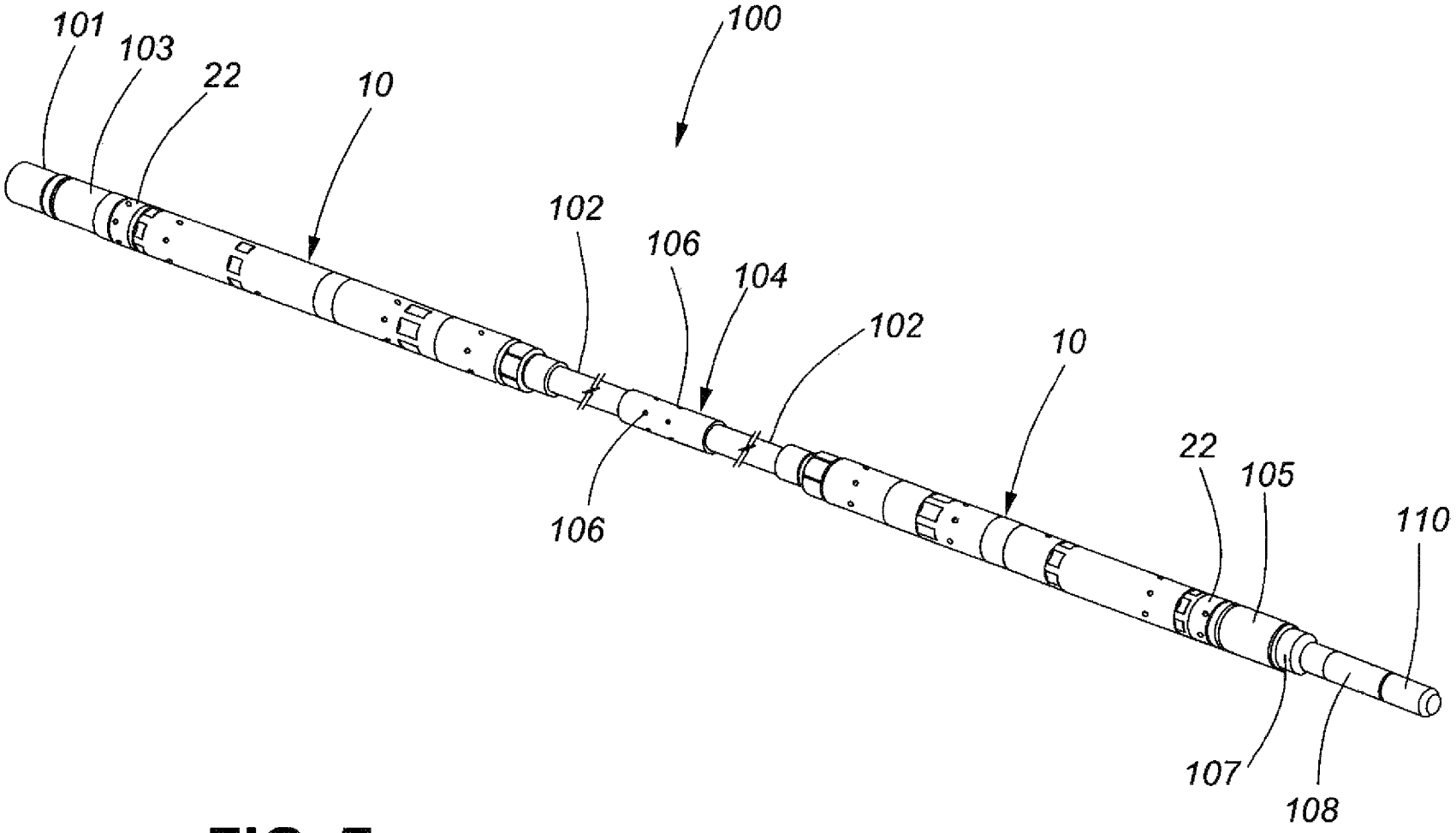
FIG. 7 is a perspective view of one embodiment of a straddle packer assembled using hydraulic pressure converters with modular force multipliers in accordance with the invention.

FIG. 7 is a perspective view of one embodiment of a long reach straddle packer 100 assembled using hydraulic pressure multipliers with modular force multipliers 10 or 10*a* in accordance with the invention. Providing a straddle packer with extended "reach" (distance between the uphole and downhole packer elements) is challenging. The pressure multipliers 10, 10*a* permit the construction of a straddle packer 100 of any desired length that can be lubricated into a well bore. In this embodiment, two pressure multipliers 10 have a mandrel tube 102 connected to their connector sleeve ends. The mandrel tubes 102 are also threadedly connected to the mandrel connector threads 88 of the respective mandrels 24 (see FIG. 3). The mandrel tubes 102 may be of any desired length, and any suitable high-pressure tubing can be used. The respective mandrel tubes 102 have opposite ends connected to a fluid injection sub 104, typically constructed from hardened steel tubing. The fluid injection sub 104 is provided with fluid injection nozzles 106, which may be case-hardened nozzles, holes, slots, or any other suitable orifice that will permit the ejection at a desired rate of well stimulation fluid from the straddle packer 100. A work string connection component 101 is connected to the mandrel transition connector end 98 of the mandrel 24 of the uphole pressure multiplier 10. The work string connection component 101 has a packer element sleeve (not shown) that supports an uphole packer element 103, which is compressed to a set condition when high pressure fluid is pumped down a work string connected to the work string connection component 101, as the pumped fluid pressure urges the uphole output force hub 22 to compress the uphole packer element 103 to a set condition. A transition hub 107 connected to the mandrel transition connector end 98 of the downhole pressure multiplier 10 has a packer element sleeve (not shown) that supports a downhole packer element 105, which is compressed by the downhole output force hub 22 to the set condition.

As explained above with reference to FIG. 2, in the set condition a compression of the uphole packer element 103 and the downhole packer element 105 is further boosted by the fluid pressure ejected into a well bore annulus isolated by the respective packer elements 103, 105 due to the force-boost area 28 (see FIG. 2) on the respective output force sleeves 20. In this embodiment, a velocity bypass sub 108 is connected to a downhole end of the transition hub 107. A function of the velocity bypass sub 108 is explained in detail in Applicant's co-pending published patent application number U.S. 2019-0195039 A1 published on Jun. 27, 2019, the specification of which is incorporated herein by reference. A tool end cap 110 terminates the straddle packer 100 and seals a central passage of the velocity bypass sub 108.

Figure 8:
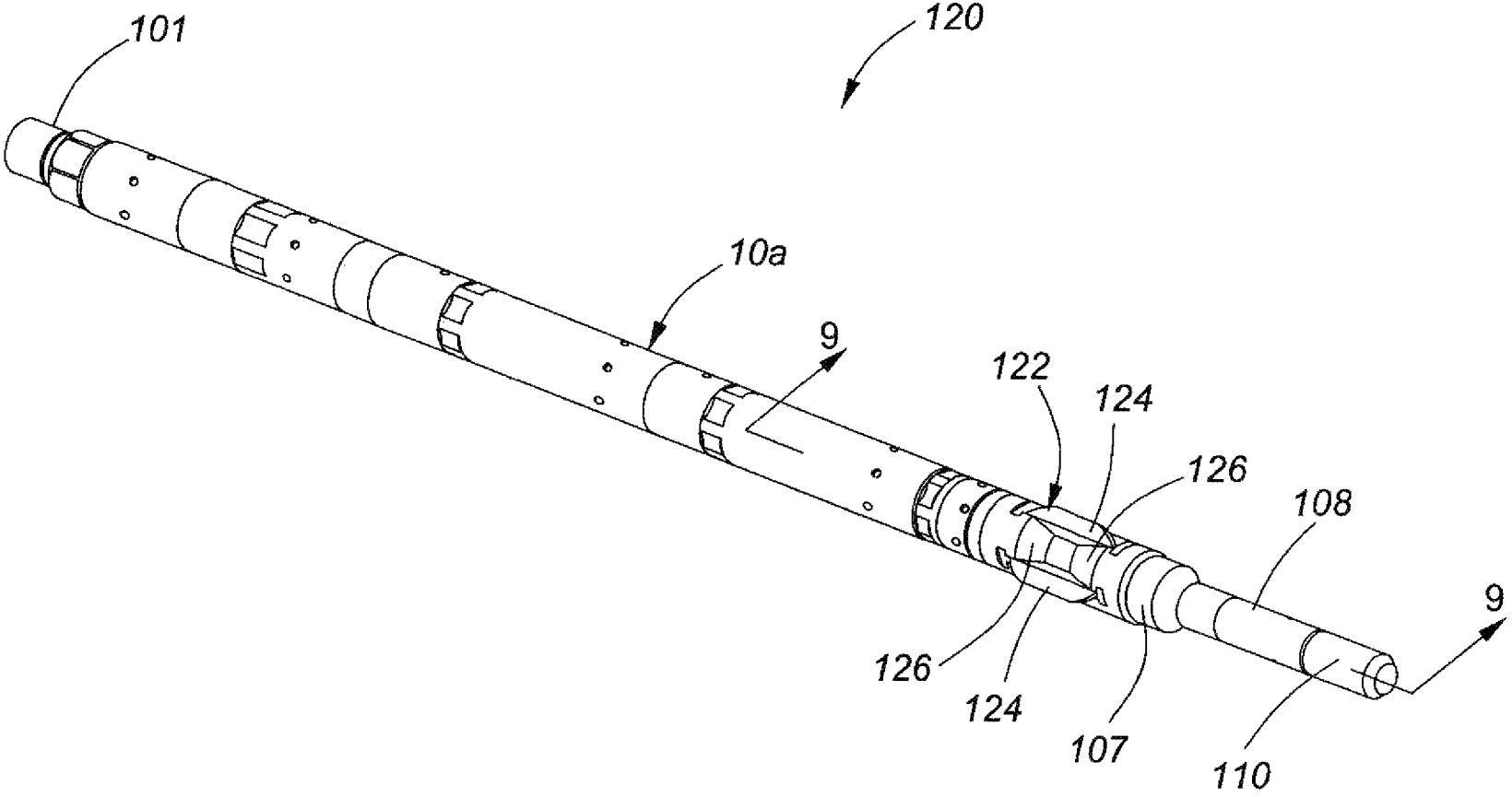
FIG. 8 is a perspective view of one embodiment of a well casing perforator constructed using the hydraulic pressure converters with modular force multipliers in accordance with the invention.

FIG. 8 is a perspective view of one embodiment of a well casing perforator 120 constructed using the hydraulic pressure multipliers with modular force multipliers 10 or 10*a* in accordance with the invention. In the illustrated embodiment, a pressure multiplier 10*a* is provided with a work string connection component 101 for connecting the casing perforator 120 to a coil tubing or a jointed tubing work string (not shown). A casing perforator body 122 is connected to the mandrel transition connector end 98 (see FIG. 9). A plurality of casing perforator blades 124 are forced upwardly by inclined ramps 126 when high-pressure fluid is pumped into the pressure multiplier 10*a* to shift the pressure multiplier 10*a* from the un-energized condition to the fully energized condition, as shown. The respective casing perforator blades perforate a well casing, as described in detail in Applicant's co-pending U.S. patent application Ser. No. 16/149,319 filed Oct. 2, 2018, the entire specification of which is incorporated herein by reference.

Figure 9:
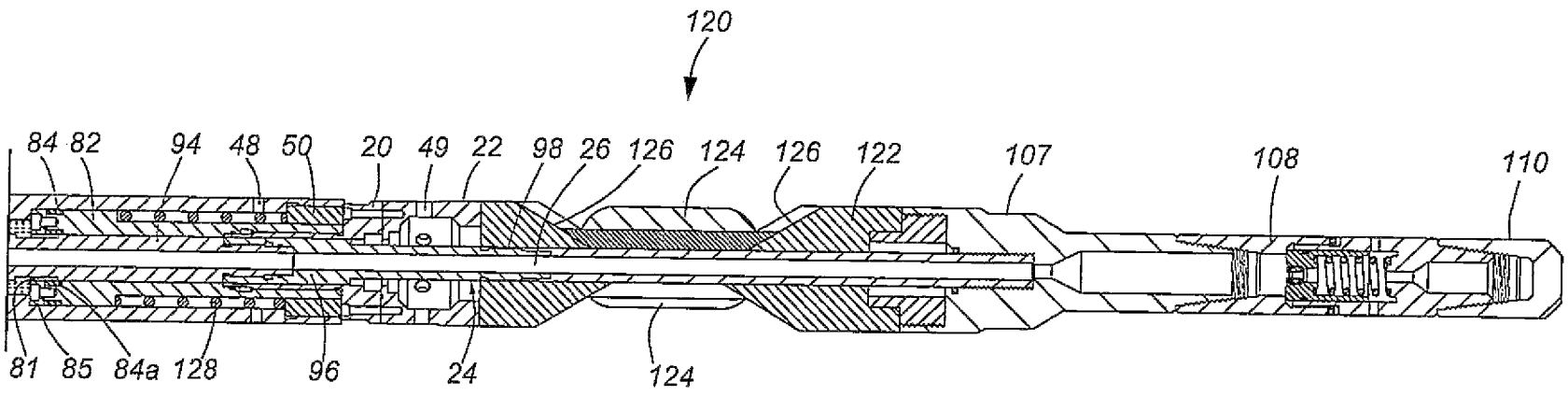
FIG. 9 is a cross-sectional view of section 8-8 of the casing cutter shown in FIG. 8, in an unenergized condition.

FIG. 9 is a cross-sectional view of section 9-9 of the casing perforator 120 shown in FIG. 8, in the un-energized condition. Each of the components of the casing perforator 120 have been described above with an exception of a means for returning the casing perforator 120 from the fully energized condition to the un-energized condition. As understood by those skilled in the art, the return function in a packer or a straddle packer may be performed by the elastomeric packer elements, most of which have very strong shape memory. However, the casing perforator blades 124 are metal and therefore passive, so some mechanism for returning the casing perforator 120 to the un-energized condition is required. By way of example, in this embodiment a compression spring 128 located on a backside of the large piston 82 of each force multiplier module provides motive force to return the casing, perforator 120 from the fully energized condition in which the Casing perforator blades 124 perforate a well bore casing to the un-energized condition shown in FIG. 9.

The explicit embodiments of the invention described above have been presented by way of example only. The scope of the invention is therefore intended to be limited solely by the scope of the appended claims.

We claim:

1. A hydraulic pressure converter with a force multiplier, comprising:

a mandrel having a mandrel central passage and mandrel piston ports that provide fluid communication through a sidewall of the mandrel;

a converter piston that reciprocates on the mandrel and has converter piston ports in fluid communication with the mandrel piston ports;

a small piston that reciprocates on the mandrel and is connected to a distal end of the converter piston, the small piston reciprocating within a small piston chamber filled with a contained fluid;

a large piston that reciprocates on the mandrel within a large piston chamber in fluid communication with the small piston chamber; and an output force hub connected to the large piston and reciprocating therewith;

whereby fluid pressure in the mandrel central passage urges the converter piston to move the small piston with a first force that is multiplied by the large piston and output by the output force hub.

2. The hydraulic pressure converter with the force multiplier as claimed in claim 1, further comprising:

a connector sleeve that connects the force multiplier to one of a work string connector and a downhole tool component;

a piston sleeve connected to the connector sleeve, the piston sleeve defining a piston chamber in fluid communication with the converter piston ports; and a force multiplier sleeve that defines the small piston chamber and the large piston chamber.

3. The hydraulic pressure converter with the force multiplier as claimed in claim 2, further comprising a transition sleeve that connects the piston sleeve to the force multiplier sleeve.

4. The hydraulic pressure converter with the force multiplier as claimed in claim 2 wherein:

the connector sleeve includes connector sleeve pressure balance ports that permit fluid pressure equalization within the connector sleeve as the pressure multiplier is shifted from an un-energized condition to a fully energized condition;

the piston sleeve includes piston sleeve pressure balance ports that balance fluid pressure on a backside of the converter piston as the pressure multiplier is shifted from the un-energized condition to the fully energized condition; and the force multiplier sleeve includes force multiplier pressure balance ports that balance fluid pressure on a backside of the large piston as the pressure multiplier is shifted from the un-energized condition to the fully energized condition.

5. A casing perforator comprising the hydraulic pressure converter with the force multiplier as claimed in claim 4 having a work string connector connected to the connector sleeve end of the force multiplier and a casing perforator body connected to an output force hub end of the force multiplier, the casing perforator body comprising a plurality of casing perforator blades that are forced up perforator blade ramps in the casing perforator body when the force multiplier is shifted to the fully energized condition.

6. The casing perforator as claimed in 5 wherein the mandrel extends through the casing perforator body and is connected to a transition hub.

7. The casing perforator as claimed in claim 6 further comprising a velocity bypass sub connected to the transition hub.

8. The hydraulic pressure converter with the force multiplier as claimed in claim 2, further comprising an output force sleeve having a first end connected to a distal end of the large piston and second end connected to the output force hub.

9. The hydraulic pressure converter with the force multiplier as claimed in claim 8 wherein the output force sleeve further comprises a force-boost area on the second end.

10. The hydraulic pressure converter with the force multiplier as claimed in claim 1 wherein the mandrel is a modular mandrel.

11. A straddle packer comprising:

a first hydraulic pressure converter with a force multiplier having a work string connector that supports a first packer element connected on a first end thereof, and a first mandrel tube connected to second end thereof;

a second hydraulic pressure converter with a force multiplier having a transition hub that supports a second packer element connected to a first end thereof, and a second mandrel tube connected to a second end thereof; and a fluid injection sub that interconnects the second end of the first hydraulic pressure converter to the second end of the second hydraulic pressure converter;

the respective hydraulic pressure converters comprising:

a mandrel having a mandrel central passage and mandrel piston ports that provide fluid communication through a sidewall of the mandrel;

a converter piston that reciprocates on the mandrel and has converter piston ports in fluid communication with the mandrel piston ports;

a small piston that reciprocates on the mandrel and is connected to a distal end of the converter piston, the small piston displacing a contained fluid within a small piston chamber on movement in the small piston chamber, and;

a large piston that reciprocates on the mandrel within a large piston chamber in fluid communication with the small piston chamber, the large piston being displaced within the large piston chamber in response to pressure changes in the contained fluid; and an output force hub connected to the large piston and reciprocating therewith;

whereby fluid pressure in the mandrel central passage urges the converter piston to move the small piston with a first force that is multiplied by the large piston and output by the output force hub.

12. The straddle packer as claimed in claim 11 further comprising a velocity bypass sub connected to the first end of the second hydraulic pressure converter.

13. The straddle packer as claimed in claim 12 further comprising a tool end cap connected to a free end of the velocity bypass sub.

14. A hydraulic pressure converter with a force multiplier comprising:

a connector sleeve having first and second ends, the first end having a connector sleeve connector end adapted to connect to one of a work string connector and a downhole tool component;

a piston sleeve having first and second ends, the first end being connected to the second end of the connector sleeve;

a force multiplier sleeve having first and second ends, the first end being connected to the second end of the piston sleeve and the second end supporting a force multiplier sleeve end cap;

a converter piston having first and second ends that reciprocates on a mandrel within the piston sleeve in response to fluid pressure within the mandrel that is communicated through mandrel piston ports in the mandrel and converter piston ports in the converter piston to a converter piston chamber;

a small piston connected to the second end of the converter piston and reciprocating therewith on the mandrel in a small piston chamber within the force multiplier sleeve, the small piston chamber being filled with a contained fluid;

a large piston that reciprocates on the mandrel in a large piston chamber within the force multiplier sleeve, the large piston reciprocating in response to displacement of the contained fluid by the small piston;

a force multiplier sleeve connected to the large piston and reciprocating on the mandrel with the large piston; and an output force hub connected to the force multiplier sleeve and reciprocating on the mandrel therewith.

15. The hydraulic pressure converter with the force multiplier as claimed in claim 14 wherein the mandrel is modular.

16. The hydraulic pressure converter with the force multiplier as claimed in claim 14 further comprising a transition sleeve that interconnects the second end of the piston sleeve and the first end of the force multiplier sleeve.

17. The hydraulic pressure converter with the force multiplier as claimed in claim 14 further comprising a multiplier transition sleeve connected to the converter piston and a small piston seal ring connected to the multiplier transition sleeve, the small piston being connected to the small piston seal ring.

18. The hydraulic pressure converter with the force multiplier as claimed in claim 14 further comprising a seal sleeve connected to the first end of the converter piston, the seal sleeve comprising a seal sleeve retainer nut and a seal sleeve seal for providing high-pressure fluid seal between the mandrel and the seal sleeve.

19. The hydraulic pressure converter with the force multiplier as claimed in claim 15, wherein the force multiplier is modular and comprises at least two of force multiplier sleeves, at least two small pistons and at least two large pistons.

* * * * *